US006127772A

United States Patent [19]

Carlson

[11] Patent Number: 6,127,772

[45] Date of Patent: Oct. 3, 2000

[54] MULTIPLE ELEMENT LAMP

[76] Inventor: Robbe Carlson, 2612 N. 160th St., Omaha, Nebr. 68116

[21] Appl. No.: 09/421,098

[22] Filed: Oct. 19, 1999

Related U.S. Application Data

[60] Provisional application No. 60/104,750, Oct. 19, 1998.

[51] Int. Cl.[7] ..... H01J 5/16

[52] U.S. Cl. ..... 313/112; 313/115; 362/61

[58] Field of Search ..... 313/578, 112, 313/581, 115, 113; 362/230, 231, 233, 61; 315/169.3, 159, 155

[56] References Cited

U.S. PATENT DOCUMENTS 4,988,925 1/1991 Biblarz ..... 313/581

5,578,893 11/1996 Yamamoto ..... 313/115

5,789,869 8/1998 Lo et al. ..... 315/159

*Primary Examiner*—Nimeshkumar D. Patel

*Assistant Examiner*—Joseph Williams

*Attorney, Agent, or Firm*—Koley Jessen P.C., A Limited Liability Organization; Mark D. Frederiksen

[57] ABSTRACT

A multiple element lamp includes an enclosure mounted on a base with a plurality of lighting elements mounted independently within the enclosure. The lighting elements are electrically connected to a control circuit in the base which selectively supplies power to the individual lighting elements. The control circuit will disconnect a lighting element upon the detection of a decrease in lighting efficiency of the element, and turn on another of the plurality of elements.

19 Claims, 3 Drawing Sheets

MULTIPLE ELEMENT LAMP

CROSS-REFERENCES TO RELATED APPLICATIONS

This application claims the benefit of U.S. Provisional Application Serial No. 60/104,750, filed Oct. 19, 1998.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1). Field of the Invention

The present invention relates to electrical lamps, and more particularly to an improved lamp having a plurality of lighting elements therein and a control circuit to selectively connect and disconnect individual elements.

(2). Background Information

The outdoor advertising business utilizes billboards with various types of illumination throughout the country. Many billboards along interstates are located in fields and the like where access may be limited because of weather and/or crop conditions. In addition, many such billboards are quite high and require the use of boom trucks or other specialized equipment in order to replace a lamp. In fact, in many cases, the cost of the labor and/or damage to fields is significantly greater than the cost of the lamp which is replaced on the billboard.

Although lamp replacement in remote areas is expensive, the cost for replacing streetlights and the like in a metropolitan area is also costly.

Not only is the expense of changing high intensity discharge lamps expensive, but there are other detrimental effects in the event that a lamp is burned out. Obviously, if a billboard has no lights, customers cannot read signs after dark, thereby leading to a loss of sales. Similarly, dim and/or unlit areas can be both safety and traffic hazards.

BRIEF SUMMARY OF THE INVENTION

It is therefore a general object of the present invention to provide an improved lamp with multiple lighting elements which may be selectively illuminated.

Another object is to provide a multiple element lamp with an electronic control circuit which will detect decreased output of a particular element, and switch power to a separate element.

A further object of the present invention is to provide an improved multiple element lamp which reduces overall energy consumption, and maintenance costs for a lamp.

These and other objects of the present invention will be apparent to those skilled in the art.

The multiple element lamp of the present invention includes an enclosure mounted on a base with a plurality of lighting elements mounted independently within the enclosure. The lighting elements are electrically connected to a control circuit in the base which selectively supplies power to the individual lighting elements. The control circuit will disconnect a lighting element upon the detection of a decrease in lighting efficiency of the element, and turn on another of the plurality of elements.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
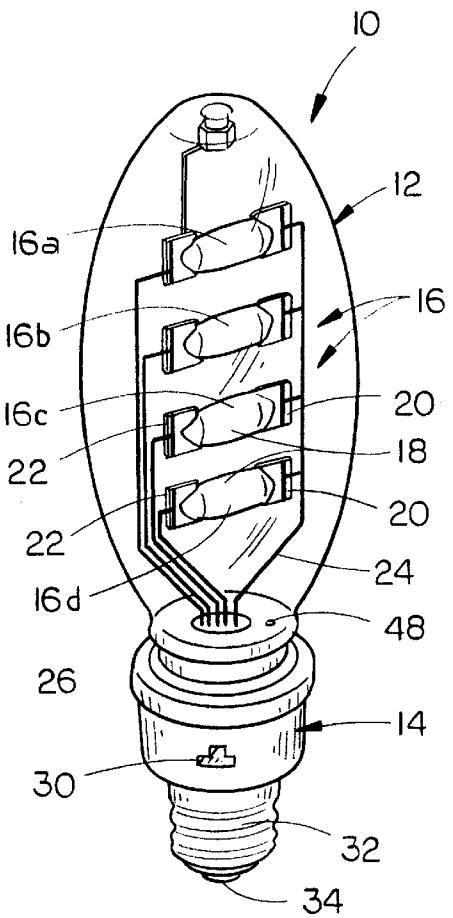
FIG. 1 is a perspective view of a multiple element lamp of the present invention.

Referring now to the drawings, and more particularly to FIG. 1, the multiple element lamp of the present invention is designated generally at 10 and includes a transparent or translucent enclosure 12 connected to a base 14. A plurality of lighting elements 16 are mounted within enclosure 12, and are preferably of a high intensity discharge type of element, having an illumination tube 18, and opposing terminals 20 and 22.

One terminal 20 on each of elements 16 are interconnected by conductor 24, which extends into the base 14. The second terminal 22 on each individual lighting element 16*a*, 16*b*, 16*c*, and 16*d* are electrically separated with their own individual conductors extending into base 14. Preferably, enclosure 12 has a floor 26 to seal the enclosure.

Base 14 includes an electronic controller 28 therein (shown in FIG. 4) which may be accessed by a data port 30 in the side wall of base 14. The lower end of base 14 is threaded at 32 for selective connection to a conventional threaded lamp socket. Threads 32 serve as one electrical terminal for base 14, with a central terminal pin 34 forming the second terminal at a conventional fashion.

Figure 2:
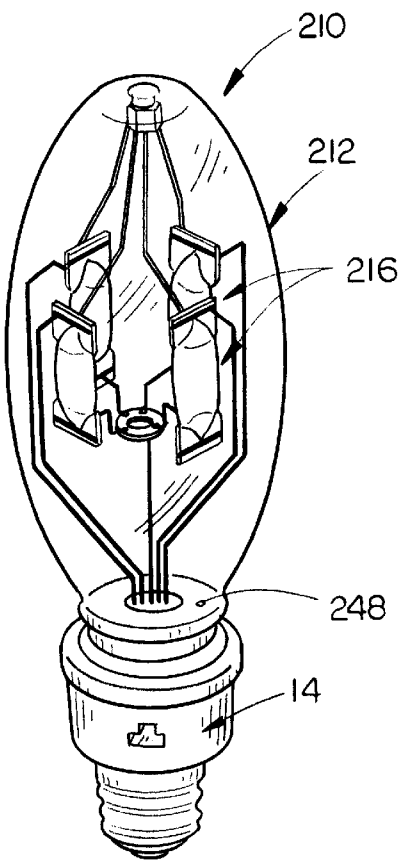
FIG. 2 is a perspective view of a second embodiment of the invention.

Referring now to FIG. 2, a second embodiment of the invention is designated generally at 210, which includes light elements 216 within enclosure 212 mounted in the same base 14 as the first embodiment of the invention. The only difference between the embodiments is the orientation of lighting elements 216 within enclosure 212.

Figure 3:
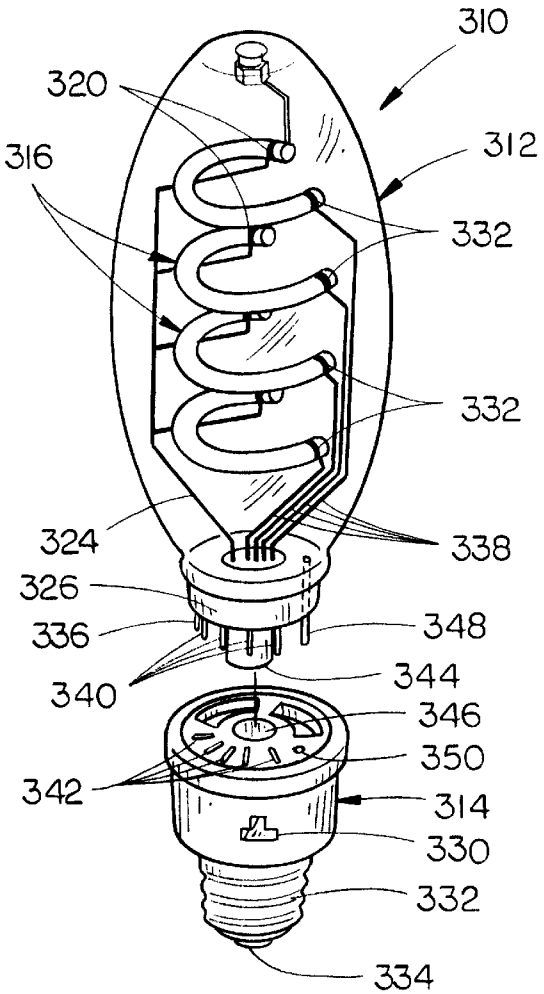
FIG. 3 is an exploded perspective view of a third embodiment of the invention.

FIG. 3 disclosures a third embodiment of the invention, designated generally at 310 with yet another configuration of lighting elements 316 arranged within enclosure 312. The third embodiment 310 also shows enclosure 312 as a removable component from the base 314. In this third embodiment, conductor 324 extending from terminals 320 is electrically connected to a pin 336 projecting downwardly from floor 326. Similarly, conductors 338 extending from each terminal 322 are connected to pins 340 extending through floor 326. Pins 336 and 340 are formed of electrically conductive material, and correspond with electrical receiver sockets 342 in base 314 to electrically connect lighting elements 316 with the controller within the base 314.

A central guide pin 344 aligns the floor 326 with base 314, and corresponds with socket 346 in base 314.

An elongated light pipe 348 has an upper end in contact with the interior of enclosure 312, and a lower end extending through floor 326 and into base 314. In the third embodiment of the invention, a cylindrical aperture 350 is provided in base 314 to permit the lower end of light pipe 348 to extend downwardly into the base into proximity of a sensor connected to the controller, as described in more detail hereinbelow.

Figure 4:
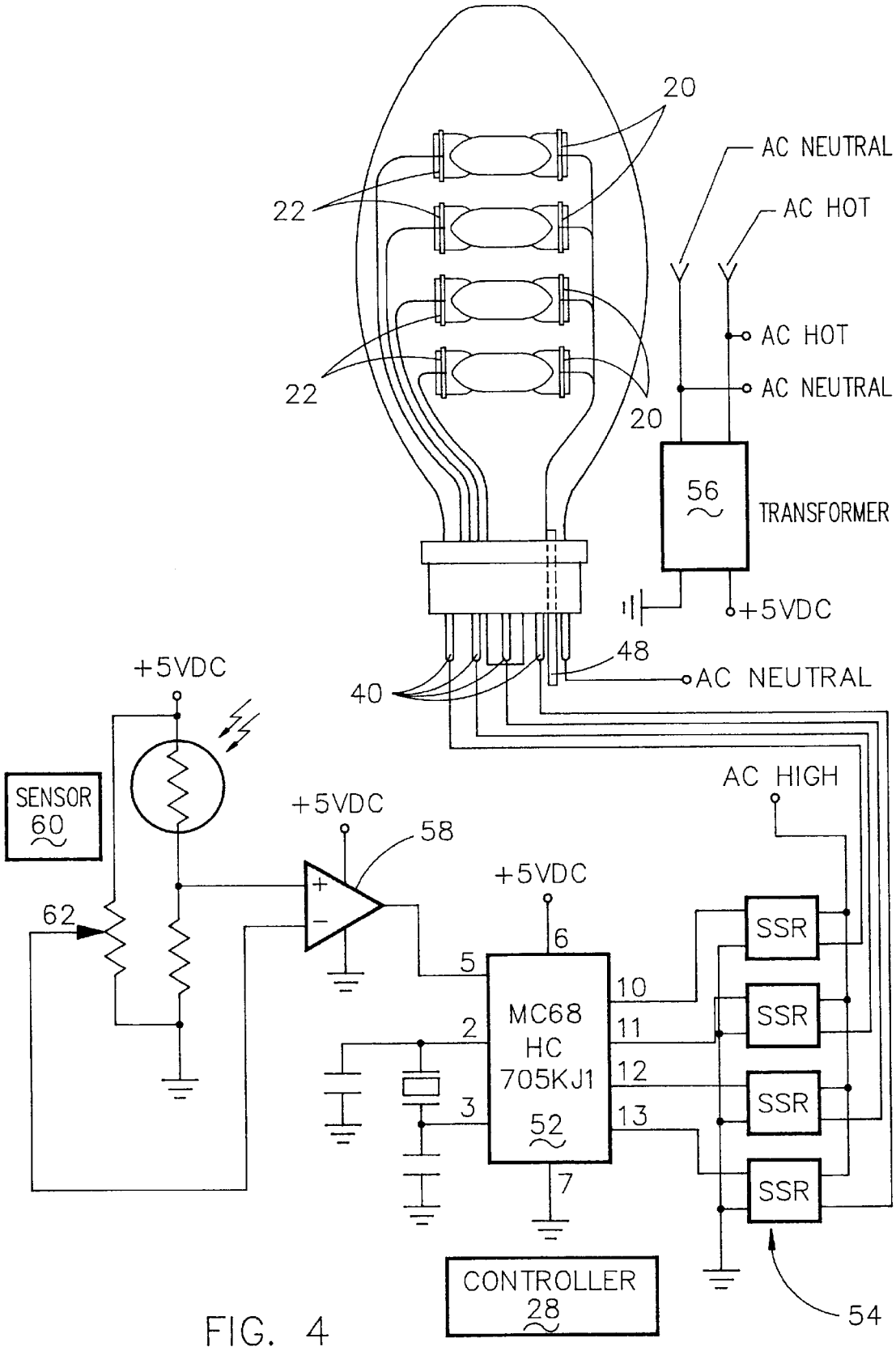
FIG. 4 is a schematic view of the electrical components of the invention.

Referring now to FIG. 4, an electrical schematic diagram of controller 28 is shown electrically connected in schematic form to lighting elements 16. Controller 28 includes a microprocessor 52 having a plurality of input/output terminals. Four microprocessor terminals are connected through solids state relays 54 and pins 40 to terminals 22 of lighting elements 16. Each relay 54 is electrically connected to the "AC hot" line of a conventional alternating current power source, to selectively connect the hot line to terminals 22 to thereby illuminate a selected lighting element 16. The terminals 20 for each lighting element 16 are electrically connected to the AC neutral line of the power supply.

A five volt DC power supply is provided by transformer 56, connected to the AC hot and AC neutral lines of the AC power supply. Transformer 56 provides low voltage direct current to microprocessor 52, transistor 58 and a sensor 60. As shown in FIG. 4, sensor 60 is a photocell which will detect the amount of light produced by an illuminated lighting element 16, passed through light pipe 48 to the proximity of sensor 60. The threshold of sensor 60 may be adjusted with variable resistor 62 in a conventional manner. It should be noted that other types of sensors 60 may be utilized within the scope of this invention. For example a sensor for detecting the color of the illuminated light could be used. In addition, a sensor detecting a change in the current or voltage of a particular lighting element 16 could be utilized as well. Sensor 60 is simply utilized to determine when a particular lighting element 16 is no longer operating at peak efficiency. Upon the occurrence of a reduction and efficiency to a predetermined level, the lighting element 16 will be switched off by microprocessor 52 via relay 54, and another lighting element will be switched on.

Figure 5:
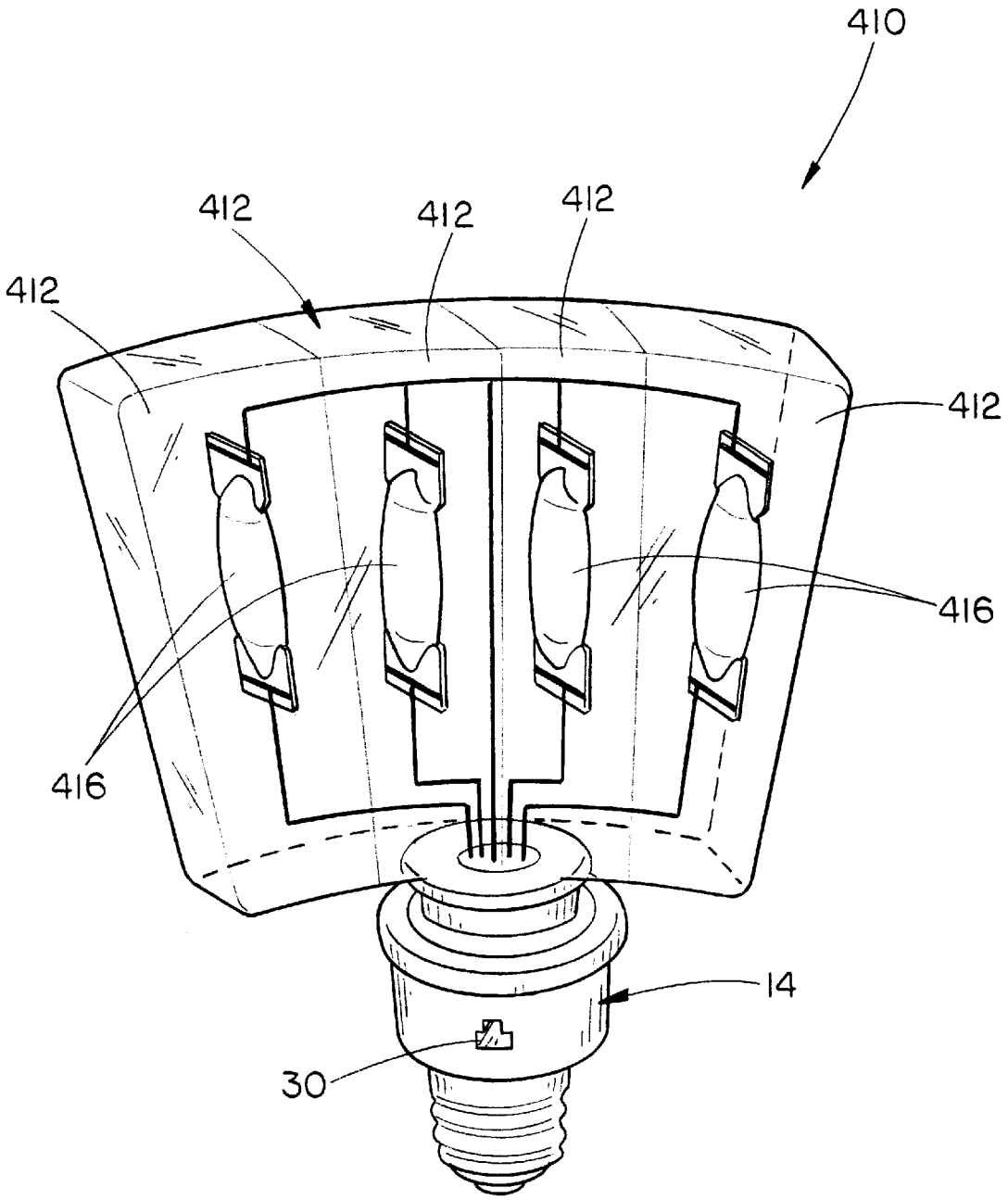
FIG. 5 is a perspective view of a fourth embodiment of the invention.

Referring now to FIG. 5, a fourth embodiment of the invention is designated generally at 410, and includes light elements 416 within a generally fan-shaped enclosure 412. In this embodiment of the invention, enclosure 412 includes four separate individual compartments 412*a*, 412*b*, 412*c*, and 412*d*, each enclosing a lighting element 416 therein. Lighting elements 416 are connected to the same base 14 as the first and second embodiments of the invention. Thus, it can be seen that elements 416 may be separately enclosed within individual compartments 412*a* through 412*d*, or positioned within a single open enclosure, as shown in the previous embodiments. It should also be noted that enclosures 12, 212, 312 and 412 are all depicted as transparent material. Obviously, this could be a frosted or translucent material, as desired by the consumer.

Data port 30 is shown with a configuration to receive a standard telephone jack, for interactive connection with the electronic controller within base 14. Other connections are possible, including wireless connections and the like, as are well known in the art.

Whereas the invention has been shown and described in connection with the preferred embodiments thereof, many modifications, substitutions and additions may be made which are within the intended broad scope of the appended claims. For example, various types of lighting elements may be utilized, including metal halide, high pressure sodium, or various incandescent or flourescent elements. In addition, various types of sensors may be utilized to detect the decrease in efficiency of a particular lighting element. Similarly, while a quartz rod is utilized as a light pipe, other method for locating the sensor within detectable distance of the lighting elements may be utilized. Obviously, various configurations of the lighting elements within the enclosure may also be used.

I claim:

1. A multiple element lamp, comprising:

hollow enclosure mounted at a lower end to a base;

a plurality of lighting elements mounted within the enclosure, operable to emit light when provided with electrical energy;

each lighting element electrically connected to an electrical control circuit, the control circuit operable to selectively illuminate one of the plurality of lighting elements;

said control circuit including means for detecting the lighting efficiency of an illuminated element, and operable to disconnect power from the illuminated element in response to the detection of lighting efficiency of the illuminated element below a predetermined level, and then to illuminate another single element of the plurality of elements; and said control circuit electrically connected to a base with first and second terminals adapted for connection to a pair of terminals of a power source.

2. The lamp of claim 1, wherein said means for detecting the lighting efficiency of a lighting element includes means for detecting the amount of light being output by an illuminated element.

3. The lamp of claim 1, wherein said means for detecting lighting efficiency of a lighting element includes means for detecting a change in the color of the light emitted by the illuminated lighting element.

4. The lamp of claim 1, wherein each lighting element is enclosed within an individual housing and spaced from the other lighting elements.

5. The lamp of claim 4, wherein said enclosure lower end includes a floor with electrical conductors extending from terminals on the lighting elements extending through said floor and connected to electrical pins projecting downwardly from the floor, wherein said base includes a plurality of receiver sockets cooperable with each of said pins, and wherein said enclosure is removably electrically connected to the base.

6. The lamp of claim 5, wherein the control circuit is mounted in the base and electrically connected through the receiver sockets and pins to the lighting elements.

7. The lamp of claim 2, wherein each lighting element is enclosed within an individual housing and spaced from the other lighting elements.

8. The lamp of claim 7, wherein said enclosure lower end includes a floor with electrical conductors extending from terminals on the lighting elements extending through said floor and connected to electrical pins projecting downwardly from the floor, wherein said base includes a plurality of receiver sockets cooperable with each of said pins, and wherein said enclosure is removably electrically connected to the base.

9. The lamp of claim 8, wherein the control circuit is mounted in the base and electrically connected through the receiver sockets and pins to the lighting elements.

10. The lamp of claim 3, wherein each lighting element is enclosed within an individual housing and spaced from the other lighting elements.

11. The lamp of claim 10, wherein said enclosure lower end includes a floor with electrical conductors extending from terminals on the lighting elements extending through said floor and connected to electrical pins projecting downwardly from the floor, wherein said base includes a plurality of receiver sockets cooperable with each of said pins, and wherein said enclosure is removably electrically connected to the base.

12. The lamp of claim 11, wherein the control circuit is mounted in the base and electrically connected through the receiver sockets and pins to the lighting elements.

13. The lamp of claim 1, wherein each lighting element is enclosed within an individual housing and spaced from the other lighting elements.

14. The lamp of claim 13, wherein said enclosure lower end includes a floor with electrical conductors extending from terminals on the lighting elements extending through said floor and connected to electrical pins projecting downwardly from the floor, wherein said base includes a plurality of receiver sockets cooperable with each of said pins, and wherein said enclosure is removably electrically connected to the base.

15. The lamp of claim 14, wherein the control circuit is mounted in the base and electrically connected through the receiver sockets and pins to the lighting elements.

16. The lamp of claim 1, wherein said enclosure lower end includes a floor with electrical conductors extending from terminals on the lighting elements extending through said floor and connected to electrical pins projecting downwardly from the floor, wherein said base includes a plurality of receiver sockets cooperable with each of said pins, and wherein said enclosure is removably electrically connected to the base.

17. The lamp of claim 16, wherein the control circuit is mounted in the base and electrically connected through the receiver sockets and pins to the lighting elements.

18. A method for reducing the frequency of lamp replacement in an electrical fixture of the type having a lamp socket and a power source, comprising the steps of:

providing a lamp with a base configured for removable engagement with the socket, the lamp including a plurality of lighting elements controlled by a control circuit operable to power a single element of the plurality, to shut off the powered element in response to a lighting efficiency of the powered element below a predetermined level and to subsequently turn on another single element of the plurality of lighting elements; and installing the lamp in the fixture socket.

19. The method of claim 18, wherein the plurality of lighting elements are mounted within an enclosure which is removably electrically connected to a base, and wherein the control circuit is operably mounted within the base; and wherein the step of installing the lamp includes the steps of:

connecting the enclosure to the base; and connecting the combination of the enclosure and base to the socket.

* * * * *